US006521102B1

(12) United States Patent
Dordi

(10) Patent No.: US 6,521,102 B1
(45) Date of Patent: Feb. 18, 2003

(54) PERFORATED ANODE FOR UNIFORM DEPOSITION OF A METAL LAYER

(75) Inventor: Yezdi N. Dordi, Palo Alto, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/534,951

(22) Filed: Mar. 24, 2000

(51) Int. Cl.[7] ..... C25D 17/00; C25D 5/08
(52) U.S. Cl. ..... 204/252; 204/283
(58) Field of Search ..... 204/283, 252

(56) References Cited

U.S. PATENT DOCUMENTS

| | | | | |
|---|---|---|---|---|
| 4,267,024 A | | 5/1981 | Weiskopf | 204/15 |
| 4,367,127 A | * | 1/1983 | Messing et al. | 204/283 |
| 5,256,274 A | | 10/1993 | Poris | 205/123 |
| 5,298,280 A | | 3/1994 | Kaczur et al. | 427/125 |
| 5,690,806 A | * | 11/1997 | Sunderland et al. | 204/283 |
| 6,093,291 A | | 7/2000 | Izumi et al. | 204/224 R |
| 6,126,798 A | | 10/2000 | Reid et al. | 204/282 |
| 6,162,333 A | * | 12/2000 | Lemon et al. | 204/283 |

FOREIGN PATENT DOCUMENTS

| | | | |
|---|---|---|---|
| GB | 2 102 836 | 2/1983 | C25D/5/08 |
| SU | 968 104 | 10/1982 | C25D/17/00 |
| WO | 99/25902 | 5/1999 | |
| WO | 99/25903 | 5/1999 | |

OTHER PUBLICATIONS

Austrian Search Report from Singapore Application No. 200101874–6, Dated Jan. 24, 2002.

* cited by examiner

*Primary Examiner*—Arun S. Phasge
(74) *Attorney, Agent, or Firm*—Moser, Patterson & Sheridan

(57) ABSTRACT

An apparatus and associated method for use in a metal deposition cell during operation. The apparatus includes a perforated anode extending generally horizontally across the entire width of the metal deposition cell. Multiple perforations extend substantially vertically and are arranged to provide a substantially uniform electrolyte flow across the width of the metal deposition cell.

20 Claims, 4 Drawing Sheets

PERFORATED ANODE FOR UNIFORM DEPOSITION OF A METAL LAYER

BACKGROUND OF THE DISCLOSURE

1. Field of the Invention

The invention relates to deposition of a metal layer on a substrate. More particularly, the invention relates to anode configurations used in electroplating.

2. Description of the Background Art

Sub-quarter micron, multi-level metallization is an important technology for the next generation of ultra large scale integration (ULSI). Reliable formation of these interconnect features permits increased circuit density, improves acceptance of ULSI, and improves quality of individual processed wafers. As circuit densities increase, the widths of vias, contacts and other features, as well as the width of the dielectric materials between the features, decrease. However, the height of the dielectric layers remains substantially constant. Therefore, the aspect ratio for the features (i.e., their height or depth divided by their width) increases. Many traditional deposition processes, such as physical vapor deposition (PVD) and chemical vapor deposition (CVD), presently have difficulty providing uniform filling of features having aspect ratios greater than 4/1, and particularly greater than 10/1. Therefore, a great amount of ongoing effort is directed at the formation of void-free, nanometer-sized features having aspect ratios of 4/1, or higher.

Electroplating, previously limited in integrated circuit design to the fabrication of lines on circuit boards, is now being used to fill vias and contacts for the manufacture of IC interconnects. Metal electroplating, in general, can be achieved by a variety of techniques. One embodiment of an electroplating process involves initially depositing a barrier layer over the feature surfaces of the wafer, depositing a conductive metal seed layer over the barrier layer, and then depositing a conductive metal (such as copper) over the seed layer to fill the structure/feature. Finally, the deposited layers are planarized by, for example, chemical mechanical polishing (CMP), to define a conductive interconnect feature.

In electroplating, depositing of a metallic layer is accomplished by delivering electric power to the seed layer and then exposing the wafer-plating surface to an electrolytic solution containing the metal to be deposited. The subsequently deposited metal layer adheres to the seed layer to provide for uniform growth of the metal layer. A number of obstacles impair consistently reliable electroplating of metal onto wafers having nanometer-sized, high aspect ratio features. These obstacles include non-uniform power distribution and current density across the wafer plating surface to portions of the seed layer.

A system that electroplates a plating surface is depicted in FIG. 1. The device, known as a fountain plater 10, electroplates a metal on a surface 15 of a substrate 48 facing, and immersed in, electrolyte solution contained within the fountain plater. The electrolyte solution is filled to the lip 83 of the interior cavity 11 defined within the electrolyte cell 12. The fountain plater 10 includes an electrolyte cell 12 having a top opening 13, a removable substrate support 14 positioned above the top opening 13 to support a substrate in the electrolyte solution, and an anode 16 disposed near a bottom portion of the electrolyte cell 12 that is powered from the positive pole of a power supply 42. The electrolyte cell 12 is typically cylindrically-shaped to conform to the disk-shaped substrate 48 to be positioned therein. Disk-shaped contact ring 20 is configured to secure and support the substrate 48 in position during electroplating, and permits the electrolyte solution contained in the electrolyte cell 12 to contact the plating surface 15 of the substrate 48 while the latter is immersed in the electrolyte solution.

A negative pole of power supply 42 is selectively connected to each of a plurality of contacts 56 (only one is depicted in FIGS. 1, 2, and 4) which are typically mounted about the periphery of the substrate to provide multiple circuit pathways to the substrate, and thereby limit irregularities of the electrical field applied to the seed layer formed on the plating surface 15 of substrate 48. Typically, contacts 56 are formed from such conductive material such as tantalum (Ta), titanium (Ti), platinum (Pt), gold (Au), copper (Cu), or silver (Ag). Substrate 48 is positioned within an upper portion 79 of the cylindrical electrolyte cell 12, such that electrolyte flows along plating surface 15 of substrate 48 during operation of the fountain plater 10. Therefore, a negative charge applied from negative pole of power supply 42 via contact 56 to a seed layer deposited on plating surface 15 of substrate 48 in effect makes the substrate a cathode. The substrate 48 is electrically coupled to anode 16 by the electrolyte solution. The seed layer (not shown) formed on a cathode plating surface 15 of substrate 48 attracts positive ions carried by the electrolyte solution. The substrate 48 thus may be viewed as a work-piece being selectively electroplated.

A number of obstacles impair consistently reliable electroplating of copper onto substrates having nanometer-sized, high aspect ratio features. These obstacles limit the uniformity of power distribution and current density across the substrate plating surface needed to form a deposited metal layer having a substantially uniform thickness.

Electrolyte solution is supplied to electrolyte cell 12 via electrolyte input port 80 from electrolyte input supply 82. During normal operation, electrolyte solution overflows from an upper annular lip 83, formed on top of the electrolyte cell 12, into annular drain 85. The annular drain drains into electrolyte output port 86 which discharges to electrolyte output 88. Electrolyte output 88 is typically connected to the electrolyte input supply 82 via a regeneration element 87 that provides a closed loop for the electrolyte solution contained within the electrolyte cell, such that the electrolyte solution may be recirculated, maintained, and chemically refreshed. The motion associated with the recirculation of the electrolyte also assists in transporting the metallic ions from the anode 16 to the surface 15 of the substrate 48. In cases where the flow of the electrolyte solution through the anode does not conform to the general horizontal cross-sectional configuration of the electrolyte cell, the resultant electrolyte solution fluid flow through the electrolyte cell 12 can be irregular, non-axial, and even turbulent. Irregular and non-axial flows may produce eddies that lead to disruption of the metal deposition in the boundary layer adjacent to substrate 48. Such non-axial flow provides uneven distribution of ions across the selected portions of plating surface 15 of substrate 48. As a result, different regions of the electrolyte solution will have different concentrations of ions, which can lead to variations in plating rate on the substrate when such variation is present in the electrolyte solution that contacts the plating surface. This uneven deposition can result in an uneven depth of electroplated material. It is desired to provide an anode shape so that flow of the electrolyte solution is as uniform across the electrolyte cell 12 as possible. Therefore it is desired that the anode acts as a diffusion nozzle that provides a uniform flow across the cathode-substrate 48.

The anode 16 shape itself can lead to difficulties in the electroplating process. Irregular shapes of the anode 16, as well as irregular flows produced by the anode, are undesired. For example, if the anode 16 is located only on the left side of the fountain plater 10 in FIG. 1, then the left side of the surface 15 of the substrate will likely be coated more heavily than the right side of the surface 15. Irregularly shaped anodes 16 also affect the electromagnetic fields generated within the fountain plater 10, that can result in variation in the electrolyte solution contacting the plating surface of the substrate. Thus it would be desirable to produce an anode 16 having the same general shape as the cathode-substrate 48 to make the electomagnetic field across the cathode-substrate 48 more consistent and limit irregularities in the electrolyte solution contacting the plating surface, and thereby make the ions deposited on the substrate at a more even depth.

After a period of use, the anode 16 degrades due to exposure to the electrolyte solution especially where the electrolytic solution is directed at the anode 16 at a high velocity. This degradation can occur irregularly across the anode 16 resulting in an anode having an irregular depth. Such an irregular depth may result in uneven application of ions across the substrate-cathode 48 thus disrupting application of a conformal layer. It would be desirable to provide a system by which the anode 16 degradation is limited such that the original anode depth and shape is maintained. The anode should be easily replaced when worn or damaged, or the depth of the anode becomes irregular.

FIG. 1 shows a prior art hydrophilic membrane 89 that is fashioned as a bag to surround the anode 16. The material of the hydrophilic membrane 89 is selected to filter anode sludge passing from the anode 16 into the electrolyte solution, while permitting ions (i.e. copper) generated by anode 16 to pass from the anode 16 to the cathode 48. Hydrophilic membranes are well known in the art and will not be further detailed herein. Electrolyte solution that is input from the electrolyte input supply 82 via input port 80 is directed along a path shown by arrows 90 around the anode. The electrolyte solution carries metallic ions from the anode 16 to the cathode 48. The flow of anode ions actually extends up to the cathode.

The flow of electrolyte solution depicted by arrows 90 initially crosses anode hydrophilic membrane 89 at reference point 91. The electrolyte solution then interacts with anode 16 causing anode ions to be released at reference point 93 because of the electrolyte solution reacting with the anode. This reaction results in a release of a material from the anode called "anode sludge" that is an unfortunate bi-product of the reaction. The anode sludge preferably remains contained within anode hydrophilic membrane 89, but may escape from the hydrophilic membrane under certain circumstances. If the anode sludge is released into the electrolyte solution, and is carried to contact the plating surface 15 of substrate-cathode 48 (especially if propelled at a high speed when it contacts the plating surface 15), then the impact of the anode sludge with the plating surface on the substrate 48 can damage the deposited layers. Therefore, it is desirable to provide a system that limits passage of the anode sludge into the electrolyte solution beyond or outside of the hydrophilic membrane.

The electrolyte solution carrying the anode ions crosses the anode hydrophilic membrane 89 again at a point indicated by reference character 95. The hydrophilic membrane 89 permitting this flow of the electrolyte solution is often referred to by those in the art as a flow-through membrane filter. A significant pressure-drop occurs each time the electrolyte solution passes through the hydrophilic membrane 89 depending partially on the filter size of the membrane filter selected. It would be desirable to reduce this pressure drop since some of the anode sludge can be forced through the membrane by the pressure drop. The pressure drop can further propel particles into contact with the substrate.

Therefore, there remains a need for an anode to be used in an electroplating apparatus that provides a substantially uniform ion flow and electric power distribution across a substrate. Such an anode configuration could be used to deposit a more reliable and consistent deposition layer on a substrate. There also remains a need to accomplish this uniform electric power distribution having a reduced pressure drop across the anode.

SUMMARY OF THE INVENTION

The invention generally provides an apparatus and associated method that deposits metal upon a substrate. The apparatus includes a perforated anode extending generally horizontally across the entire width of the metal deposition cell. Multiple perforations extend substantially vertically that provide a more uniform electrolyte flow across the width of the metal deposition cell. In one embodiment, a hydrophilic membrane limits particles that have eroded from the perforated anode from impinging upon the substrate. The membrane may extend across the entire width of the metal deposition cell. Alternatively, the membrane may extend across only those portions that lie directly above the perforated anode, therefore allowing electrolyte flow across the perforated anode without encountering a membrane.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

After considering the following description, those skilled in the art will clearly realize that the teachings of this invention can be readily utilized in any application based upon depositing a metal layer upon an object.

Figure 1:
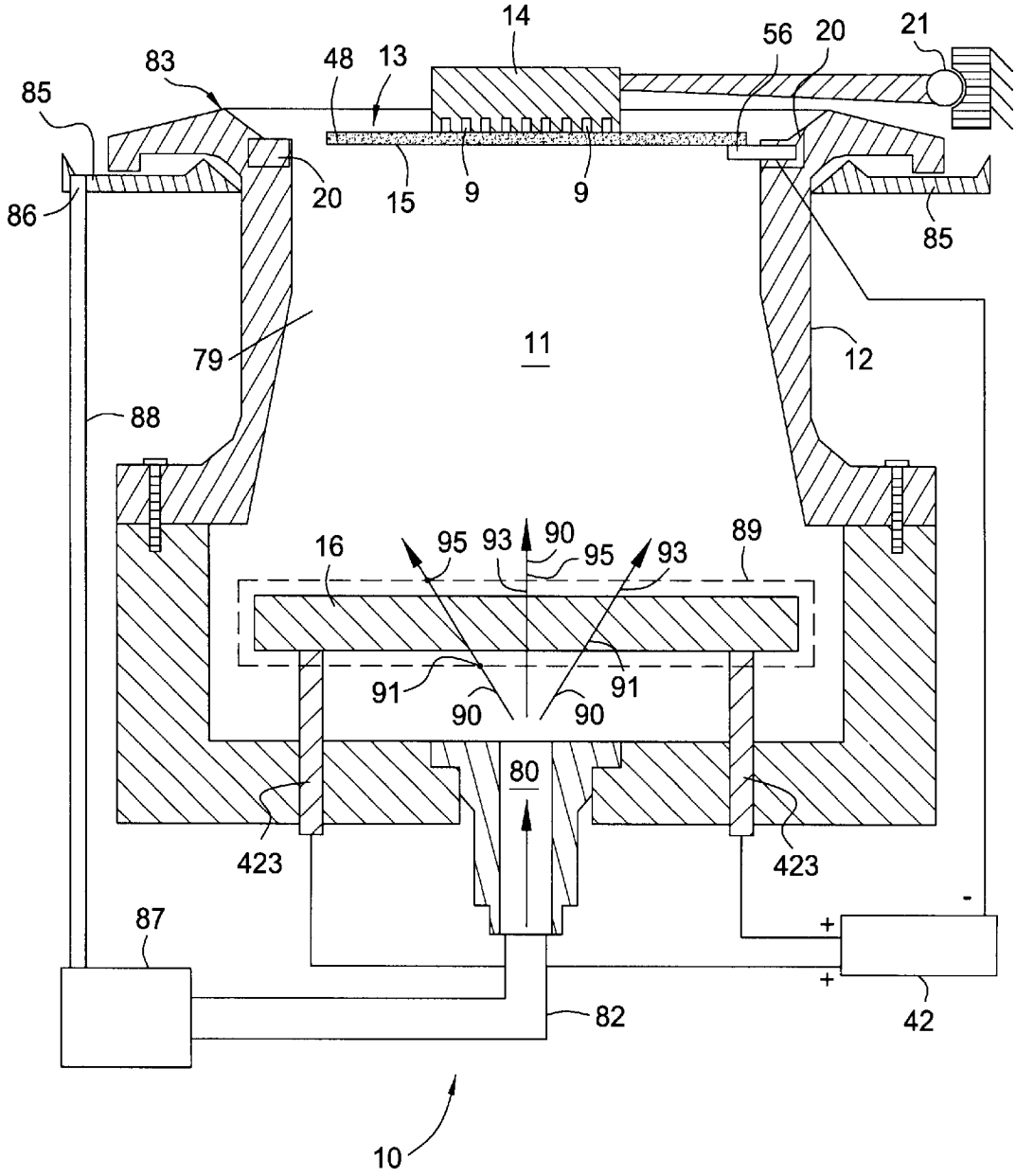
FIG. 1 (PRIOR ART)
FIG. 1 depicts a cross-sectional view of one embodiment of prior art fountain plater including an anode and a cathode-substrate.
Figure 2:
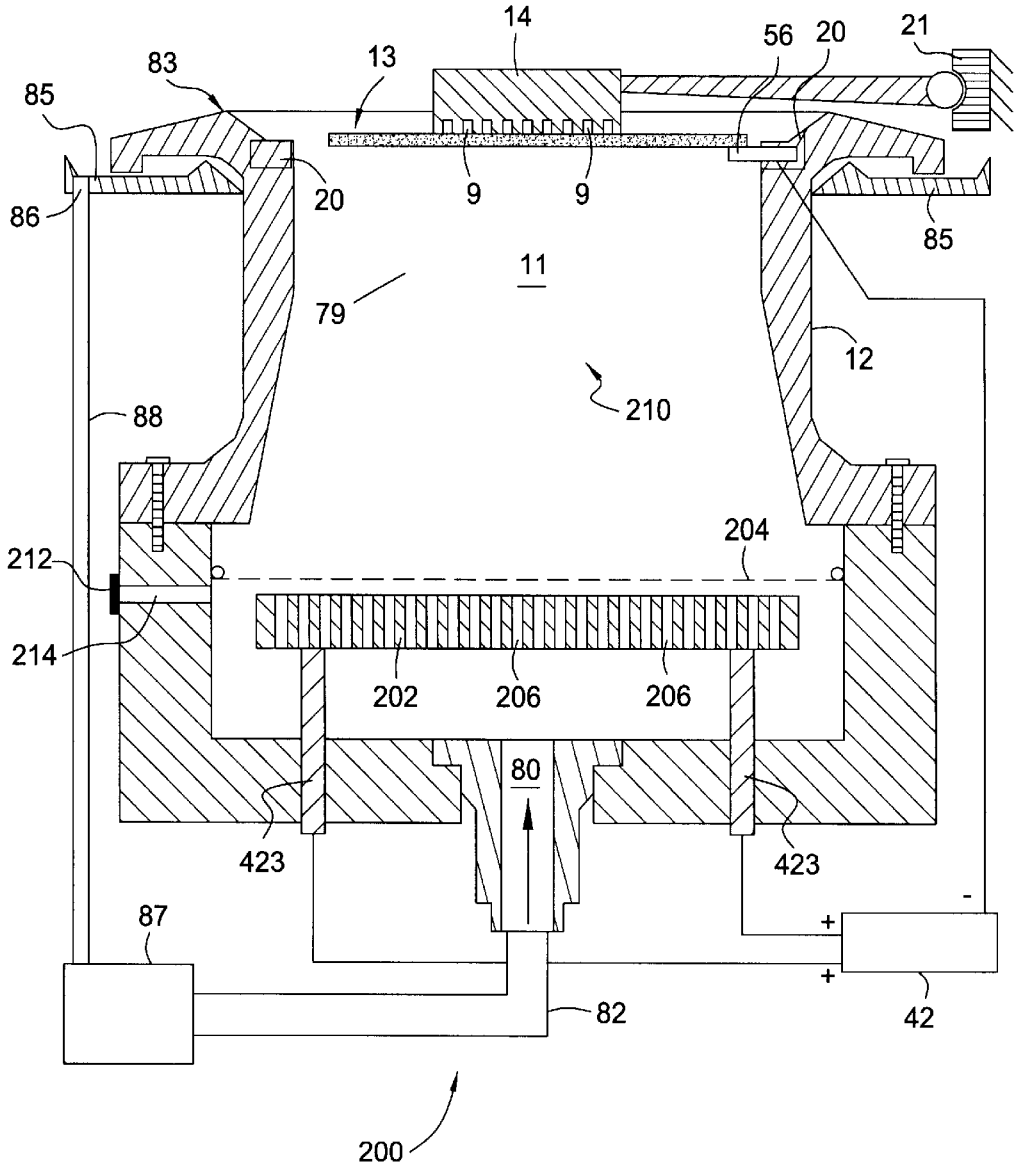
FIG. 2 depicts a cross-sectional view of a fountain plater with one embodiment of the present invention including a perforated anode.

There are two embodiments of fountain platers having perforated anodes that are described herein. The first embodiment is described with particular reference to FIG. 2. The second embodiment is described relative to FIG. 4. FIG. 2 depicts one embodiment of fountain plater 200 of the present invention. The fountain plater 200 includes an electrolyte cell 12, a perforated anode 202, and a hydrophilic membrane 204. The perforated anode 202 contains perforations 206 formed therein. The perforations generally extend vertically as shown in FIG. 2 to permit flow of an electrolyte solution from the electrolyte input port 80 to an upper chamber 210 defined by the electrolyte cell 12, and then out of electrolyte output port 86. The perforations 206 are preferably formed in a regular pattern about the perforated anode 202 as depicted in the top plan view of FIG. 3. The perforated anode is preferably formed from copper, although any suitable metal (e.g., aluminum), material, or alloy used for anodes may be used. The electrolyte cell 12 is configured to contain electrolyte solution that is used during the electroplating process to deposit metal on the substrate. Though an electroplating process is detailed herein, the basic concepts may be applied to any wet deposition process.

In this disclosure, directional terms such as up, down, left, right, etc. are used. These terms are descriptive to the reader upon viewing the associated figure(s), but are not intended to limit the scope of the invention. These directions should be considered relative to the accompanying figures, and should not be considered as limiting the scope since the electrolyte cell 12 can be positioned in a variety of orientations.

The substrate support 14 contains channels 9 that are in communication with a vacuum device (not shown). The substrate support is pivotably mounted by a support mount 21 between an immersed position and a removed position. When the substrate support 14 positions the substrate 48 in the immersed position, the metallic ions contained in the electrolyte solution are capable of being deposited on the plating surface 15. When the substrate support 14 positions a substrate in the immersed position, the plating surface of the substrate will be immersed in the electrolyte solution contained in the electrolyte cell 12. When the substrate support 14 is pivoted to the removed position, the substrate is removed from the electrolyte solution. The vacuum applied to the channels of the substrate support 14 are sufficient to attach the substrate support to the backside of the substrate with sufficient force to secure a substrate 48 on the substrate support. This force is sufficient to retain the substrate in position even when the substrate is being held in the inverted position, or when the substrate is being removed from, or inserted into, the electrolyte solution. The substrate support 14 is configured to be disposed over the opening 13 with the substrate 48 attached to the substrate support.

Hydrophilic membrane 204 in the embodiment shown in FIG. 2 extends generally parallel to the perforated anode 202, and is closely spaced (e.g., half a centimeter) above the perforated anode. The hydrophilic membrane may be connected to the inside of the walls of the electrolyte chamber 12 by a clamp, a ring, or any known technique by which a fabric is secured to be attached to extend across the interior of a generally cylindrical member. The hydrophilic membrane 204 contains perforations that are sized to permit ions generated by the perforated anode 202 to pass therethrough. However, larger portions of the anode, such as shavings, by-products, and other debris remaining in the electrolyte solution (known collectively as anode sludge), are filtered from the electrolyte and remain within the hydrophilic membrane 204. This filtering process keeps these contaminants from contacting the substrate 48. To remove the contaminants, sealable flushport 212 including a removable seal 214 is positioned below the hydrophilic membrane 204. The removable seal may be occasionally opened to allow the anode sludge to drain from within the electrolyte cell 12 to a region external to the cell. This draining improves the integrated operation of the hydrophilic membrane 204 and the perforated anode 202.

Figure 4:
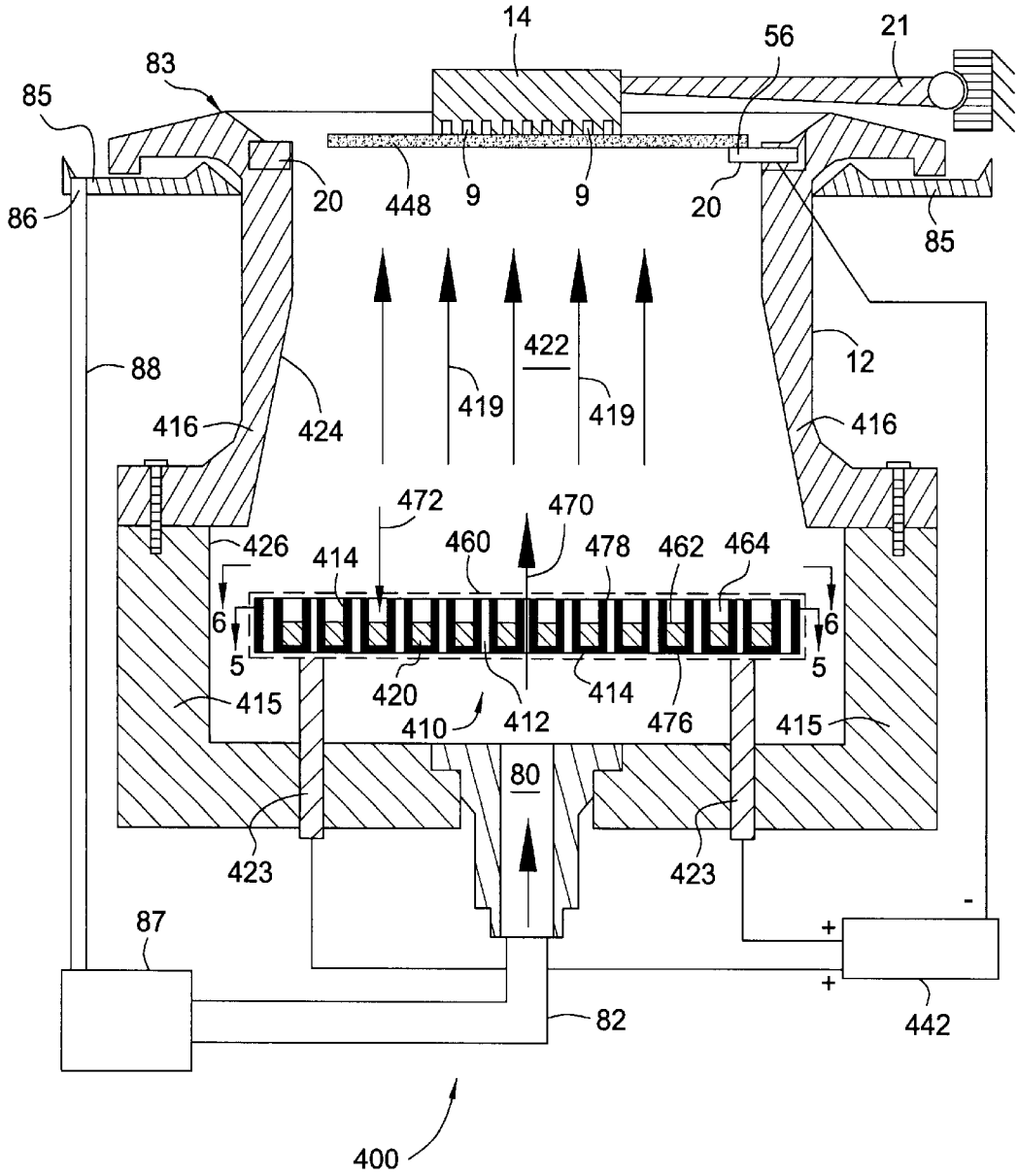
FIG. 4 depicts a cross-sectional view of an alternate embodiment of fountain plater including an anode assembly of the present invention.

The perforations 206 that are distributed across the perforated anode 202 act as a diffusion plate to distribute the flow of the electrolyte solution traversing the perforated anode 202 substantially uniformly across the width of the electrolyte cell 12. Although relatively few perforations are depicted in FIG. 4, in actuality there may actually be a much larger number of perforations in the perforated anode. The perforations are preferably arranged in an array, and are the perforations are horizontally spaced from the neighbor perforation by two millimeters or less. The diameter of each perforation may be as small as several millimeters or less. The perforations cause the perforated anode to act as a diffusion nozzle to substantially equalize the vertical flow of the electrolyte solution across the horizontal cross section of the electrolyte cell. The perforated anode 202 in FIG. 2 may alternatively be configured with relatively few perforations (including one). Generally, though, the smaller the number of perforations 206, the larger the diameter of each of the perforations 206 should be to maintain a laminar flow having a desirable flow rate through the perforated anode.

The distribution of flow of the electrolyte solution across the horizontal cross section of the electrolyte cell ensures that a more uniform distribution of electrolyte is applied to a lower face 50 of the substrate 48. This uniformity results since the electrolyte solution impinging the plating surface across the electrolyte cell should be traveling with a nearly uniform velocity. This perforated configuration results in a uniform, and predictable, application of metal ions to those areas on the substrate that has a seed layer. The embodiment of the invention shown in FIG. 2 uses a hydrophilic membrane that, in practice, has been shown capable of filtering particles having a minimum size of approximately 10 $\mu$m in diameter.

The perforated anode 202 configuration is configured to enhance laminar flow of the electrolyte solution into the upper chamber 210. The perforations 206 formed therein may be considered diffusers of the fluid passing therethrough that maintains a laminar flow of the electrolyte solution within the electrolyte solution. Maintaining as laminar flow as possible through the perforated anode 206 is essential since turbulence in the electrolyte solution produced by the solution passing though the perforated anode 202 could produce eddies that can have the effect of uneven distribution of ions within the electrolyte solution. Inversely, a laminar flow of the electrolyte solution results in a more even distribution of the metal ions being deposited across the plating surface of the substrate.

Additionally, there are two types of substrate boundary layers that may be effected by turbulence. The first type of boundary layer is referred to as fluid boundary layer that relates to how laminar the fluid flow is adjacent the plating surface of the substrate. The second type of boundary layer is referred to as ion starved boundary layer in which ion concentration within the electrolyte solution varies as a function of the location in a vias or other features. Turbulent flow in the upper chamber 210 adjacent the plating surface of the substrate can reduce the width of a fluid boundary layer by generating current eddys that may impinge upon, or effect the concentration of ions in, the boundary layer. Such a current eddy impinging upon the fluid boundary layer would disrupt the laminar flow of the fluid boundary layer. A sufficiently thick fluid boundary layer provides a region of relatively stable fluid adjacent the surface that is important for depositing ions on the plating surface (that are carried from the electrolyte solution). A sufficient fluid boundary layer is necessary to provide a volume at which the metal ions can be deposited on the surface. Additionally, if the flows and eddies associated with turbulent flow is applied directly to plating surface 50, then some of the deposited material that has settled thereupon may be removed by the turbulent fluid action.

The ion starved boundary layer adjacent the plating surface is also affected by turbulence in the electrolyte solution. Metal layering within vias, trenches, and other features depend upon a substantially uniform concentration of ions within the electrolyte solution. Turbulence near the plating surface may attract or repel the ions from adjacent electrolyte solution, thereby making the concentration of metallic ions within the electrolyte solution non-uniform. Such non-uniformity in the concentration of the ions contained in the electrolyte solution often greatly effects the metal ion deposition rate (especially within the vias, trenches, or certain other features). For the fluid boundary layer and the ion starved boundary layer reasons described above, maintaining a laminar flow in the electrolyte solution contained in the upper chamber 210 (especially adjacent the plating surface) is important for applying and maintaining a uniform source of ions to the seed layer formed on the plating surface 50 of the substrate 46.

Figure 3:
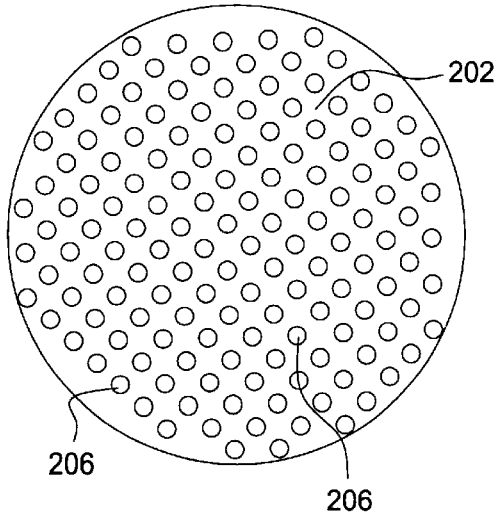
FIG. 3 depicts a top view of the anode shown in the FIG. 2 embodiment.
Figure 5:
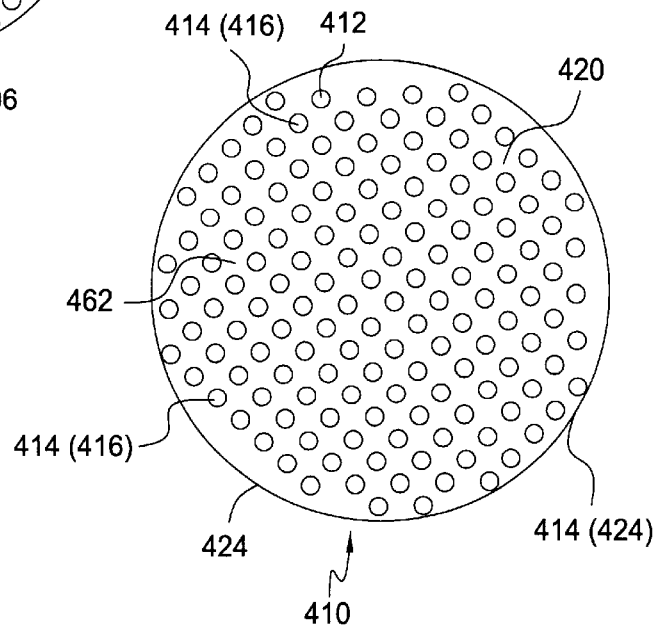
FIG. 5 depicts a sectional view of the anode assembly of FIG. 4 as taken along sectional lines 5—5 of FIG. 4.
Figure 6:
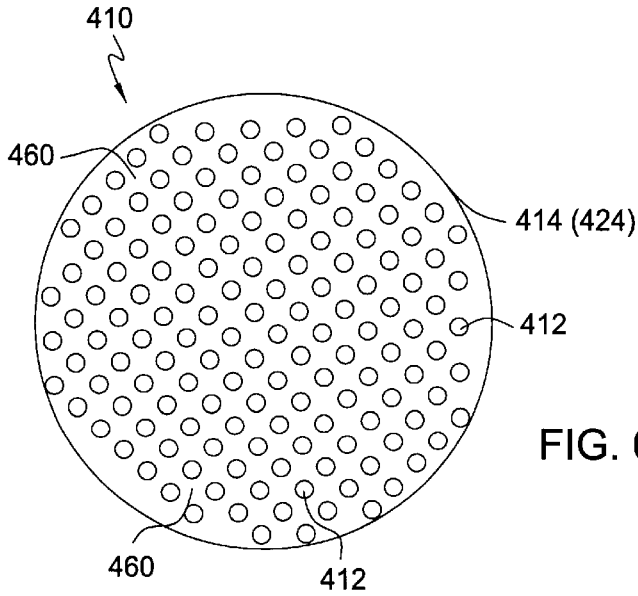
FIG. 6 depicts a sectional view of the anode assembly of FIG. 4, as taken along section lines 6—6 of FIG. 4.

FIG. 4 depicts another embodiment of a perforated anode assembly to be applied to a fountain plater 400, e.g., electroplating device. The electroplating device 400 includes a cathode-substrate 448, a modular anode assembly 410, and a power supply 442 that maintains an electric field generated between the cathode-substrate 448, and the modular anode assembly 410 as described below. The modular anode assembly 410 is shown in plan view in FIGS. 5 and 6 as taken through respective section lines 5—5 and 6—6 of FIG. 4. In FIGS. 3, 5 and 6, thicker lines are used to depict cross-sectional lines of impervious casing, while thinner lines are used to depict all other lines.

The modular anode assembly 410 is formed as a modular unit such that it may be inserted into position, secured in position, or removed to be repaired or replaced when worn or broken. The modular anode assembly 410 comprises perforated anode 420 having perforations 412 formed therein. The perforated anode 420 is positioned within impervious casing 414. The electrolyte container 12 comprises a base portion 415 attached to the flux straightener 416 by nuts and bolts, screws, twist clips, other removable fasteners, or other known type of fasteners. The connection between the flux straightener 416 and the base portion 415 is sufficient to limit the electrolyte solution contained in the electrolyte cell from passing between the two elements. The base portion 415 is secured to the perforated anode 420 by feed thoughts that extend through the impervious casing 414 to provide electricity to the perforated anode. The flux straightener 416 is configured to allow magnetic flux lines extending from the perforated anode 420 to the substrate to be substantially parallel to each other as shown by arrows 419. Since the path of travel of metal ions travelling from the perforated anode to the substrate largely follows the magnetic flux lines 419, the parallel orientation of the magnetic flux lines 419 between the perforated anode and the substrate enhances the uniformity of the charge density across the substrate plating surface as well as uniform depositions of the metal ions across the substrate.

The impervious casing 414 is preferably formed from a non-soluble material such as plastic to limit chemical and electromagnetic reactivity with the electrolyte solution. The electrolytic solution supplied through electrolyte input port 80 (that carries metal ions after passing the modular anode assembly 410) does not impinge with velocity directly upon perforated anode 420 since the direction of travel of the electrolyte solution entering the electrolyte chamber must change before it can contact the perforated anode, as described below.

The anode base portion 476 of the impervious casing 414 is defined about, and forms cylindrical sidewalls for, the modular anode assembly 410. Feed throughs 423 physically attach to the modular anode assembly 410 to support it in position, and contain an electrical connector that supplies electricity from the power supply 442 to the perforated anode 420. This configuration permits electrolyte solution supplied from electrolyte input port 80 to pass through the perforated anode 420 to the upper portion 422 defined within the electrolyte cell 12. The flux straightener 416 functions as a diffuser to produce a laminar flow of the electrolyte solution in a manner as described above relative to the perforated anode 202 in the embodiment of FIG. 2. To replace the modular anode assembly, the flux straightener 416 is unattached from the base portion 415 by unscrewing, unbolting, de-coupling the two elements, or unattaching the particular type of connection between the flux straightener 416 and the base portion 415. The modular anode assembly 410 is then removed from the base portion 415 by unattaching either the connection between the modular anode assembly 410 and the feed throughs 423 or the connection between the feed throughs 423 and the base portion 415 (by removing the whatever fasteners are providing the connection between the elements). The modular anode assembly is then separated from the base portion 415. A replacement modular anode assembly is reattached to the base portion by following the inverse operation by which the original modular anode assembly was unattached from the base portion. The flux straightener 416 is then reattached to the base portion 415.

Before inserting a replacement modular anode assembly 410 into a fountain plater 400, the replacement modular anode assembly 410 is preferably stored in a container filled with a liquid (typically electrolyte solution). The components of the modular anode assembly 410 thus become saturated with the fluid contained in the container, and the gasses that were originally contained in the modular anode assembly 410 prior to insertion into the container are removed by being displaced by the fluid. Existence of gasses in the fountain plater 400 could disrupt the electrolyte flow therein, that could degrade the quality of the electroplating.

Though the feed throughs 423 have been described above as providing support for the modular anode assembly 410 relative to the base portion 415, any other known type of support for the modular anode assembly relative to the base portion 415 or other segment of the electrolyte cell 12 could be provided. Any type of securement device may be used to maintain the modular anode assembly 410 relative to the electrolyte cell 12. For example, the modular anode assembly could be mounted or fastened to the base portion 415 via feed throughs. Alternately, the modular anode assembly 410 may be bolted within the electrolyte cell. Any known system (such as screws, wedges, screw-locks, slip locks, etc.) that removably affixes the modular anode assembly 410 in the embodiment of FIG. 4 relative to the electrolyte cell 12 is within the intended scope of a securement device for the modular anode assembly.

The perforations 412 formed in the perforated anode 420 are regularly spaced as depicted in FIGS. 5 and 6, and are as closely spaced as practical, to provide a nearly-uniform flow of the electrolyte solution from the electrolyte input supply 82 to the upper chamber 422. In this manner, the electrolyte solution applied to the plating surface 50 should have a nearly uniform vertical flow across horizontal cross-section of the cathode-substrate 48. This nearly uniform flow is important so those areas of the plating surface 50 that contain a charged seed layer will produce a metal layer (not shown) where the thickness of each metal layer has a nearly-uniform thickness. It is envisioned that as few as one perforation 412 may be formed in the perforated anode 420 while remaining within the scope of the present invention. However, fewer perforations provided in the perforated anode also usually requires larger individual perforation diameters to maintain a suitable, substantially uniform, laminar flow. If there are few perforations, there is typically a greater need for a ceramic diffuser (not shown, but known in the art) located downstream of the modular anode assembly 410 (i.e. between the perforated anode and the substrate) to provide uniform flow to the cathode-substrate 48. Such diffusers have the effect of maintaining the laminar flow.

The impervious casing 414 limits contact of the electrolyte solution entering from the electrolyte input port 80 from impinging directly upon the bottom, the sides, or the perforations of the perforated anode 420. However, it is not designed to limit passage of electrolyte solution to the perforated anode 420 from above as depicted in FIG. 4. The circumferential edge portion 424 of the flux straightener 416 extends vertically above the back side of the perforated anode 420 as depicted in FIG. 4.

A hydrophilic membrane 460 partially extends above and secures to the perforated anode 420. The hydrophilic membrane 460 filters electrolyte solution passing between the reactant space 464 and the volume defined between the perforated anode 420 and the flux straightner 416. A recess is cut in those portions of the hydrophilic membrane 460 that are disposed above each chimney portion 412, thereby permitting free vertical flow of electrolyte solution through each chimney portion (without the vertical flow being limited by having to pass through the hydrophilic membrane). This removal of the hydrophilic membrane above the chimneys limits the fluid pressure drop that is generated across the hydrophilic membrane. Reactant space 464 is defined between the upper surface 462 of the perforated anode 420, the impervious casing, and the hydrophilic membrane 460. The reactant space 464 is configured to contain relatively static fluid, and improves the reaction between the electrolyte solution and the material of the perforated anode. Electrolytic solution contained in the upper chamber 422 may back-flow into the reactant space 464 by crossing the hydrophilic membrane 460 to provide an electrolytic solution continuum extending from the upper surface 462 of the perforated anode 420 to the plating surface 50 of cathode-substrate 448.

The fluid flow in reactant space 464 is nearly stagnant to improve the hydrodynamic effects of the electrolyte solution upon perforated anode 420 (hydrodynamic effects decrease under turbulent flow). This electrolyte solution continuum enables ions generated by the perforated anode 420 to diffuse in the electrolyte solution across the hydrophilic membrane 460 to the cathode-substrate 448 (and more particularly the seed layer contained on plating surface 50 when power supply 442 is applied). Since the metallic ions are being inserted into the electrolyte solution into the reactant spaces 464 and crossing the hydrophilic membrane 460, there will likely be slight non-uniformities in ion concentration between the electrolyte solution passing directly through the chimney portions 412 and the electrolyte solution traveling from the reactant spaces 464 through the hydrophilic membrane since the latter electrolyte solution has had an opportunity to interact directly with the perforated anode. The nearly stagnant fluid characteristics of the electrolyte solution contained within the reactant space 464 limits the tendency of the anode sludge contained in the reactant space to be forced across the hydrophilic membrane under the influence of the pressure drop. To limit non-uniformities in the metal ion concentrations in the electrolyte solution that has passed from the perforated anode, the distances between chimney portions 412 and the diameters of the chimney portions should be decreased, both of which tend to limit the vertical dimensions between varying metal ion concentrations. Under these conditions, irregularities in ion concentrations across the horizontal cross section of the electrolyte cell directly above the modular anode assembly will equalize as the electrolyte solution travels vertically to the plating surface of the substrate due to the diffusion of the metal ions within the electrolyte solution and the slight lateral currents in the electrolyte solution contained in the electrolyte container.

The impervious casing 414 has chimney portions 416 that extend into perforations in the perforated anode 410 of FIG. 4, guards the perforated anode from direct contact with electrolyte solution flowing from the electrolyte input supply 82. This electrolyte solution flow through the electrolyte chamber 12 typically occurs at a flow rate of between 0.5 and 15 gallons per minute. Electrolyte injected at this velocity could degrade the material of the perforated anode 410 if the electrolyte solution directly impinged upon the perforated anode. Though every perforated anode eventually degrades from being sacrificed into the electrolyte, degradation increases considerably when the electrolyte flow is applied (especially at high velocities) directly against a surface of the perforated anode 410. Additionally, applying a fast-flowing electrolyte solution directly to a surface of the perforated anode 410 depletes the organic additives (by oxidation) that are contained in the electrolyte solution, and which are needed to maintain a proper chemical balance for electroplating.

The reaction of the electrolyte solution with the perforated anode in FIG. 4 can be better understood by observing the direction that the electrolyte fluid flows within the electrolyte cell 12. The electrolyte solution entering the electrolyte chamber 12 through input port 80 follows the general direction depicted by arrow 470. For the electrolyte solution to contact the perforated an e, the electrolyte solution must travel in the direction depicted by arrows 472 after the electrolyte solution crosses the perforated anode. Therefore, any fluid that contacts the perforated anode must enter the reactant space 464, requiring that this fluid travels in the direction indicated by arrow 470 that is substantially opposed the direction of the general flow of the electrolyte solution within the electrolyte cell. The impervious casing 414 is depicted in FIG. 4 as having openings covered by hydrophilic membrane 460, any electrolyte solution entering the reactant space must cross the hydrophilic membrane once when traveling into the reactant space 464 in a direction indicated by arrow 470, and cross the hydrophilic membrane again when exiting the reactant space 464 in the direction indicated by arrow 472. Any impervious casing 414 configuration that limits direct impingement of a general electrolyte solution flow upon the anode 420 is within the scope of the present invention.

The impervious casing 414 in the embodiment of FIG. 4 limits the direct application of the electrolyte solution from the electrolyte input supply 82 upon a surface of the perforated anode 420. The only surface of the perforated anode that is directly exposed to the electrolyte solution is the upper surface 462 that is on the opposite side of the perforated anode 420 from the electrolyte input supply 82. All contact of electrolyte solution with the perforated anode involves electrolyte solution that has previously passed in an upwardly direction into the upper chamber 422, and then back-flowed into reactant space 464 after traversing the hydrophilic membrane 460. The reactant space 464, defined by upper surface 462 of perforated anode 420, impervious casing 414, and hydrophilic membrane 460 is configured to maintain the electrolyte solution nearly static. This static electrolyte solution within the reactant space 464 is desired to permit diffusion of ions from the perforated anode 420, while minimizing erosion of the anode in an irregular shape. The static state of the electrolyte solution contained in the reactant space also limits depletion of the organic additives in the electrolyte solution. The maintenance of the levels of organic additives within the electrolyte solution is important to provide proper deposition of the ions upon the plating surface 50 of the substrate 448.

Additionally, the hydrophilic membrane 204 depicted in FIG. 2 extends across the entire width of the electrolyte cell 12. In the embodiment of FIG. 4, no portion of hydrophilic membrane 460 extends across the chimney portions 412. Therefore, a large percentage of the electrolyte solution passing from the electrolyte input supply 82 passes through the chimney portions 412 into the upper chamber 422 without having to cross any hydrophilic membrane 460. The fact that the electrolyte solution passing through chimney portions 412 does not have to cross the hydrophilic membrane limits the associated pressure drop at the hydrophilic membrane. Because the hydrophilic membrane 460 does not impede electrolyte flow and no pressure drop is created, fine hydrophilic membranes 460 that can filter particles having a size greater than 0.16 $\mu$m in diameter can be used. The use of a fine hydrophilic membrane decreases the dimension and amount of anode sludge and particulate matter transported across the hydrophilic membrane to the space within the electrolyte chamber 12 between the modular anode assembly and the cathode-substrate 448.

Although various embodiments, which incorporate the teachings of the present invention, have been shown and described in detail herein, those skilled in the art can readily devise many other varied embodiments that still incorporate these teachings.

What is claimed is:

1. An anode assembly, comprising:

a perforated anode having a first side, a second side, and at least one perforation extending from the first side to the second side; and an anode casing extending adjacent the first side and a second portion extending into and lining the at least one perforation.

2. The anode assembly of claim 1, further comprising a membrane disposed adjacent the first side.

3. The anode assembly of claim 2, wherein the membrane is not disposed within said perforations.

4. The anode assembly of claim 2, wherein the membrane filters particles eroded from the anode.

5. The anode assembly of claim 2, wherein the membrane is hydrophilic.

6. The anode assembly of claim 1, wherein the perforated anode further comprises a side peripheral surface, and the anode casing is disposed adjacent the side peripheral surface.

7. The anode assembly of claim 1, wherein the perforated anode and the anode casing are formed as a modular unit.

8. The anode assembly of claim 1, wherein the perforated anode has a plurality of perforations.

9. The anode assembly of claim 1, wherein the anode casing is configured as a shield from electrolyte solution that limits electrolyte solution being directed towards a substrate from contacting the anode.

10. The anode assembly of claim 1, wherein the at least one perforation is configured to provide uniform flow to a substrate plating surface.

11. The anode assembly of claim 1, further comprising a membrane disposed less than 0.5 cm from the first side of the anode.

12. The apparatus of claim 1, wherein the membrane comprises a seal to flush eroded particles from the anode.

13. The anode assembly of claim 1, wherein the perforated anode comprises copper.

14. The anode assembly of claim 1, wherein the perforated anode has a plurality of perforations spaced less than about 2 mm apart.

15. The anode assembly of claim 1, wherein the perforated anode has a plurality of perforations having a diameter of less than about 7 mm.

16. The anode assembly of claim 1, wherein the anode casing comprises a non-soluble material.

17. The anode assembly of claim 1, wherein the anode casing comprises plastic.

18. An electroplating cell, comprising:

a perforated anode having a plurality of perforations configured to pass a plating solution therethrough;

an anode casing configured to form cylindrical sidewalls around the plurality of perforations and reduce chemical reactions between the anode and the plating solution; and a hydrophilic membrane disposed between the anode and plating solution inlet, wherein the hydrophilic membrane has a distance from the anode of less than about 0.5 cm.

19. The electroplating cell of claim 18, wherein the hydrophilic membrane extends along an entire plating cell diameter.

20. The electroplating cell of claim 18, wherein the hydrophilic membrane has a plurality of perforations sized to permit ions generated by the anode to pass therethrough and inhibit the passage of anode by-products.

* * * * *

UNITED STATES PATENT AND TRADEMARK OFFICE

CERTIFICATE OF CORRECTION

PATENT NO. : 6,521,102 B1
DATED : February 18, 2003
INVENTOR(S) : Dordi

It is certified that error appears in the above-identified patent and that said Letters Patent is hereby corrected as shown below:

Column 10,
Line 47, please change “an e,” to -- anode --.

Signed and Sealed this

Twenty-ninth Day of July, 2003

JAMES E. ROGAN
*Director of the United States Patent and Trademark Office*